US009371490B2

(12) United States Patent
Colenbrander et al.

(10) Patent No.: US 9,371,490 B2
(45) Date of Patent: Jun. 21, 2016

(54) METHOD FOR EXTRACTING BITUMEN FROM AN OIL SAND STREAM

(71) Applicants: Shell Canada Energy, Calgary (CA); Chevron Canada Limited, Calgary (CA); Marathon Oil Canada Corporation L.P., Calgary (CA)

(72) Inventors: Gerhardus Willem Colenbrander, Amsterdam (NL); Ingmar Hubertus Josephina Ploemen, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 13/890,956

(22) Filed: May 9, 2013

(65) Prior Publication Data

US 2013/0334105 A1 Dec. 19, 2013

(30) Foreign Application Priority Data

May 10, 2012 (CA) ..... 2776608

(51) Int. Cl.

| | |
|---|---|
| ***C10G 1/04*** | (2006.01) |
| ***C10G 31/09*** | (2006.01) |
| ***C10G 21/14*** | (2006.01) |
| ***C10G 53/04*** | (2006.01) |
| ***C10G 21/28*** | (2006.01) |

(52) U.S. Cl.

CPC *C10G 1/045* (2013.01); *C10G 1/04* (2013.01); *C10G 21/14* (2013.01); *C10G 21/28* (2013.01); *C10G 31/09* (2013.01); *C10G 53/04* (2013.01); *C10G 2300/208* (2013.01); *C10G 2300/44* (2013.01)

(58) Field of Classification Search

CPC ..... C10G 1/04; C10G 1/045; C10G 21/14; C10G 21/28; C10G 21/30; C10G 31/09; C10G 53/04; C10G 53/06

USPC ..... 208/390, 311, 312, 337, 425

See application file for complete search history.

(56) References Cited

U.S. PATENT DOCUMENTS

| | | | | |
|---|---|---|---|---|
| 3,475,318 | A | 10/1969 | Gable et al. | 208/11 |
| 4,036,732 | A * | 7/1977 | Irani et al. | 208/390 |
| 4,139,450 | A * | 2/1979 | Hanson et al. | 208/390 |
| 2008/0210602 | A1 * | 9/2008 | Duyvesteyn | 208/390 |
| 2009/0301937 | A1 | 12/2009 | Duyvesteyn et al. | 208/390 |

* cited by examiner

*Primary Examiner* — Renee E Robinson

(57) ABSTRACT

The present invention provides a method for extracting bitumen from an oil sand stream, the method including the steps of: (a) providing an oil sand stream; (b) contacting the oil sand stream with a liquid comprising a solvent thereby obtaining a solvent-diluted oil sand slurry; (c) separating the solvent-diluted oil sand slurry, thereby obtaining a first solids-depleted stream and a first solids-enriched stream; (d) filtering the first solids-enriched stream obtained in step (c), thereby obtaining bitumen-depleted sand and at least a first filtrate; (e) increasing the S/B weight ratio of at least a part of the first filtrate by combining it with a stream having a higher S/B weight ratio thereby obtaining a combined stream; and (f) separating the combined stream, thereby obtaining a second solids-depleted stream and a second solids-enriched stream.

21 Claims, 2 Drawing Sheets

TS 7128

METHOD FOR EXTRACTING BITUMEN FROM AN OIL SAND STREAM

RELATED APPLICATIONS

This application claims the benefit of Canadian Application No. 2,76,608 filed May 10, 2012, which is incorporated herein by reference.

BACKGROUND OF THE INVENTION

The present invention relates to a method for extracting bitumen from an oil sand.

Various methods have been proposed in the past for the recovery of bitumen (sometimes referred to as "tar" or "bituminous material") from oil sands as found in various locations throughout the world and in particular in Canada such as in the Athabasca district in Alberta and in the United States such as in the Utah oil sands. Typically, oil sand (also known as "bituminous sand" or "tar sand") comprises a mixture of bitumen (in this context also known as "crude bitumen", a semi-solid form of crude oil; also known as "extremely heavy crude oil"), sand, clay minerals and water. Usually, oil sand contains about 5 to 25 wt. % bitumen (as meant according to the present invention), about 1 to 13 wt. % water, the remainder being sand and clay minerals.

As an example, it has been proposed and practiced at commercial scale to recover the bitumen content from the oil sand by mixing the oil sand with water and separating the bitumen froth from the aqueous slurry formed. Disadvantages of such aqueous extraction processes are the need for extremely large quantities of process water (typically drawn from natural sources) and issues with removing the bitumen from the aqueous phase (whilst emulsions are being formed) and removing water from the bitumen-depleted sand (and clay).

Other methods have proposed non-aqueous extraction processes to reduce the need for large quantities of process water. Example of such a non-aqueous extraction process are disclosed in e.g. U.S. Pat. No. 3,475,318 and US 2009/0301937, the teaching of which is hereby incorporated by reference.

There is a continuous desire to improve the process efficiency in methods for extracting bitumen from an oil sand stream. It is an object of the present invention to meet this desire and to provide a more efficient method for extracting bitumen from an oil sand stream.

It is a further object of the present invention to provide an alternative non-aqueous solvent based extraction process for extracting bitumen from an oil sand.

SUMMARY OF THE INVENTION

One or more of the above or other objects may be achieved according to the present invention by providing a method for extracting bitumen from an oil sand stream, the method comprising at least the steps of:

(a) providing an oil sand stream;

(b) contacting the oil sand stream with a liquid comprising a solvent thereby obtaining a solvent-diluted oil sand slurry;

(c) separating the solvent-diluted oil sand slurry, thereby obtaining a first solids-depleted stream and a first solids-enriched stream;

(d) filtering the first solids-enriched stream obtained in step (c), thereby obtaining bitumen-depleted sand and at least a first filtrate;

(e) increasing the S/B weight ratio of at least a part of the first filtrate by combining it with a stream having a higher S/B weight ratio thereby obtaining a combined stream; and (f) separating the combined stream, thereby obtaining a second solids-depleted stream and a second solids-enriched stream.

It has now surprisingly been found according to the present invention that the filtration process is more efficient when it is executed at conditions under which all (or substantially all) asphaltenes in the bitumen are dissolved.

A further advantage of the present invention is that the main bitumen product stream is derived from the filtrate(s). Under conditions under which all asphaltenes are dissolved, such filtrate(s) will typically have a considerably lower solids content (at most 5.0 wt. % solids, preferably at most 2.0 wt. % solids) than the liquid stream that has been obtained in the solids/liquid separation step upstream of the filter, which is used to derive the bitumen product from in other proposed bitumen extraction processes.

An even further advantage of the present invention is that a bitumen product with a very low solids content may be produced. By combining specific parts of the bitumen-rich and solvent-rich filtrate streams, asphaltene precipitation is induced enabling almost complete removal of the fine solids from the product through settling.

According to the present invention, the providing of the oil sand in step (a) can be done in various ways. Typically, before contacting the dry oil sand (which may contain some water being present in the oil sand) with the solvent the oil sand lumps are reduced in size, e.g. by crushing, breaking and/or grinding, to below a desired size upper limit. Experience in large scale operations shows that the achievable size upper limit for such size reduction is currently about 8 inch.

The contacting in step (b) of the oil sand with the liquid comprising a solvent thereby obtaining a solvent-diluted oil sand slurry is not limited in any way. As an example, the liquid may be added before, during or after the size-reducing step (if available) of the oil sand. Further size reduction in the presence of the liquid (comprising the solvent) may be performed; part of the size reduction may take place by dissolution of bitumen present in the oil sand (bitumen acts as a bonding agent for the oil sand lumps), but further size reduction e.g. by using screens and/or again crushers, breaker or grinders may be performed, if desired. Typically, the solvent forms the major part of the liquid and is preferably present in an amount of from 40 wt. % up to 100 wt. %, preferably above 60 wt. %, more preferably above 70 wt. %, even more preferably above 80 or even above 90 wt. %, based on the amount of the liquid. The liquid may contain some solids, for example if the liquid is recycled from a downstream part of the process.

The solvent as used in the method of the present invention may be selected from a wide variety of solvents, including aromatic hydrocarbon solvents and saturated or unsaturated aliphatic (i.e. non-aromatic) hydrocarbon solvents; aliphatic hydrocarbon solvents may include linear, branched or cyclic alkanes and alkenes and mixtures thereof. Preferably, the solvent in step (b) comprises an aliphatic hydrocarbon having from 3 to 9 carbon atoms per molecule, more preferably from 4 to 7 carbons per molecule, or a combination thereof. Especially suitable solvents are saturated aliphatic hydrocarbons such as propane, butane, pentane, hexane, heptane, octane and nonane (including isomers thereof), in particular butane, pentane, hexane and heptane. It is preferred that the solvent in step (b) comprises at least 90 wt. % of the aliphatic hydrocarbon having from 3 to 9 carbon atoms per molecule, preferably at least 95 wt. %. Also, it is preferred that in step (b) substantially no aromatic solvent (such as toluene or benzene) is present, i.e. less than 5 wt. %, preferably less than 1 wt. %.

Further it is preferred that a single solvent is used as this avoids the need for a distillation unit or the like to separate solvents.

The oil sand may intrinsically contain some water (and in some embodiment water may be added); preferably the solvent-diluted slurry comprises less than 15 wt. % water, preferably less than 10 wt. %.

Preferably, the lumps in the solvent-diluted oil sand slurry obtained in step (b) are screened or reduced in size to have a diameter below 5.0 cm, preferably below 2.0 cm, more preferably below 1.0 cm. As the screening or size reduction is performed in the presence of solvent (rather than size reduction under dry conditions), this helps breaking down the larger lumps and dissolving the bitumen. Additionally, by mixing the oil sand stream with the solvent before performing the filtration (in step (d)), the viscosity of the bitumen present in the oil sand is reduced, which leads to a (desired) increased filtration rate.

Preferably, the solvent-diluted oil sand slurry obtained in step (b) has such a S/B weight ratio that at least 75 wt. %, preferably at least 90 wt. %, more preferably at least 95 wt. % (and most preferably substantially all) of the asphaltenes in the bitumen remain dissolved to avoid asphalthene precipitation. The person skilled in the art will readily understand that the appropriate S/B weight ratio to achieve this is dependent on the solvent(s) used. Preferably, the solvent-diluted oil sand slurry obtained in step (b) has a solvent-to-bitumen (S/B) weight ratio of from 0.5 to 1.5, preferably above 0.6 and preferably below 1.3, more preferably below 1.1.

Further it is preferred that the solvent-diluted oil sand slurry obtained in step (b) comprises from 10 to 60 vol. % of solids, preferably from 20 to 40 vol. %, more preferably from 25 to 35 vol. %.

After contacting the oil sand with the solvent in step (b) to obtain a solvent-diluted oil sand slurry, the solvent-diluted oil sand slurry is separated in step (c), thereby obtaining a first solids-depleted stream and a first solids-enriched stream. The person skilled in the art will understand that the separation in step (c) may be done in multiple stages, e.g. to reduce or prevent fines build-up in the front end of the process.

Usually, the slurry stream as separated in step (c) has about the same S/B weight ratio as when obtained during the contacting of step (b), but may deviate somewhat if further solvent streams are added just before separating in step (c).

Preferably, the first solids-enriched stream obtained in step (c) comprises from 30 to 70 vol. % of solids, preferably above 40 vol. %, more preferably above 50 vol. %. Typically, the first solids-enriched stream obtained in step (c) has about the same S/B weight ratio as the solvent-diluted oil sand slurry obtained in step (b), hence preferably from 0.5 to 1.5.

The first solids-depleted stream obtained in the separation of step (c) may have several uses. Preferably, at least a part of the first solids-depleted stream is reused in the contacting of step (b), to maintain a desired solvent content during the contacting of step (b). In some embodiments, all of the solids-depleted stream is reused in the contacting of step (b). In other embodiments, at least a part of the first solids-depleted stream is reused in the separation of step (e).

In step (d), the solids-enriched stream is filtered thereby obtaining bitumen-depleted sand and at least a first (usually bitumen-containing) filtrate. Usually, the bitumen-depleted sand is dried, thereby obtaining a dried bitumen-depleted sand stream containing less than 500 ppmw, preferably less than 300 ppmw, of the solvent.

The person skilled in the art will readily understand that in step (d) one or more filtrates may be obtained which may be reused in other parts of the process. In case only one filtrate stream is obtained, this single filtrate stream is the "first" filtrate stream. However, typically two or more filtrate streams are obtained.

Preferably, the first filtrate has a S/B weight ratio of from 0.5 to 1.5, preferably above 0.6, more preferably above 0.7 and preferably below 1.3, more preferably below 1.1. Further it is preferred that the first filtrate comprises at most 5.0 wt. % solids, preferably at most 2.0 wt. % solids, based on the bitumen content of the first filtrate. Typically, the first filtrate comprises at least 0.01 wt. % solids, based on the bitumen content of the first filtrate.

The person skilled in the art will readily understand that the filtering in step (d) can be performed in many different ways. Although some fresh solvent may be used at the start-up of the process of the present invention, the addition of fresh solvent later on is preferably kept to a minimum; most of the solvent used in the filtration step is recycled from downstream of the process. Also, the splitting of the one or more filtrates in the first and/or second (and optionally further) filtrates can be performed in various ways. Typically, the first filtrate obtained in step (d) leaves the filter cake earlier than the second filtrate obtained in step (d).

In a preferred embodiment a part of the first filtrate is reused in the contacting of step (b). Further it is preferred that in step (d) a second filtrate is obtained, which is preferably at least partly reused in the contacting of step (b). Preferably, the second filtrate is relatively bitumen-depleted and preferably has a S/B weight ratio of above 3.0, more preferably above 5.0 and typically below 200.

In step (e) the S/B weight ratio of at least a part of the first filtrate is increased by combining it with a stream having a higher S/B weight ratio thereby obtaining a combined stream. Typically, the combining takes place in a mixing unit. In case an aliphatic solvent is used in both steps (b) and (e), which is preferred, the increase in the S/B weight ratio may cause the precipitation of at least some of the asphaltenes present in the combined stream.

The stream having a higher S/B weight ratio in step (e) may be any stream or combinations of streams and may include pure solvent. According to an especially preferred embodiment, in step (e) at least a part of the first filtrate is combined with at least a part of the second filtrate to get the combined stream. Also it is preferred that in step (e) the combined stream has a S/B weight ratio of at least 1.1, preferably above 1.2, more preferably above 1.3.

In step (f) the combined stream is separated thereby obtaining a second solids-depleted stream and a second solids-enriched stream. Typically, solvent is recovered from this second solids-depleted stream and subsequently the bitumen may be sent to a refinery or the like for further upgrading. The separation in step (f) typically takes place in a clarifier, or in any other suitable solid/liquid separator (including gravity separators and cyclones); as the person skilled in the art is familiar with this kind of separators, this is not further discussed in detail. If desired, agglomeration agents such as alkali, Portland cement, lime, ash, polymers, gypsum, etc. may be used in the separation of step (f) to promote the formation of aggregates.

It is preferred that the second solids-enriched stream obtained in step (f) is reused in the filtering of step (d).

Hereinafter the invention will be further illustrated by the following non-limiting drawing. Herein shows:

DETAILED DESCRIPTION OF THE INVENTION

For the purpose of this description, a single reference number will be assigned to a line as well as a stream carried in that line. Same reference numbers refer to the same or similar elements.

Figure 1:
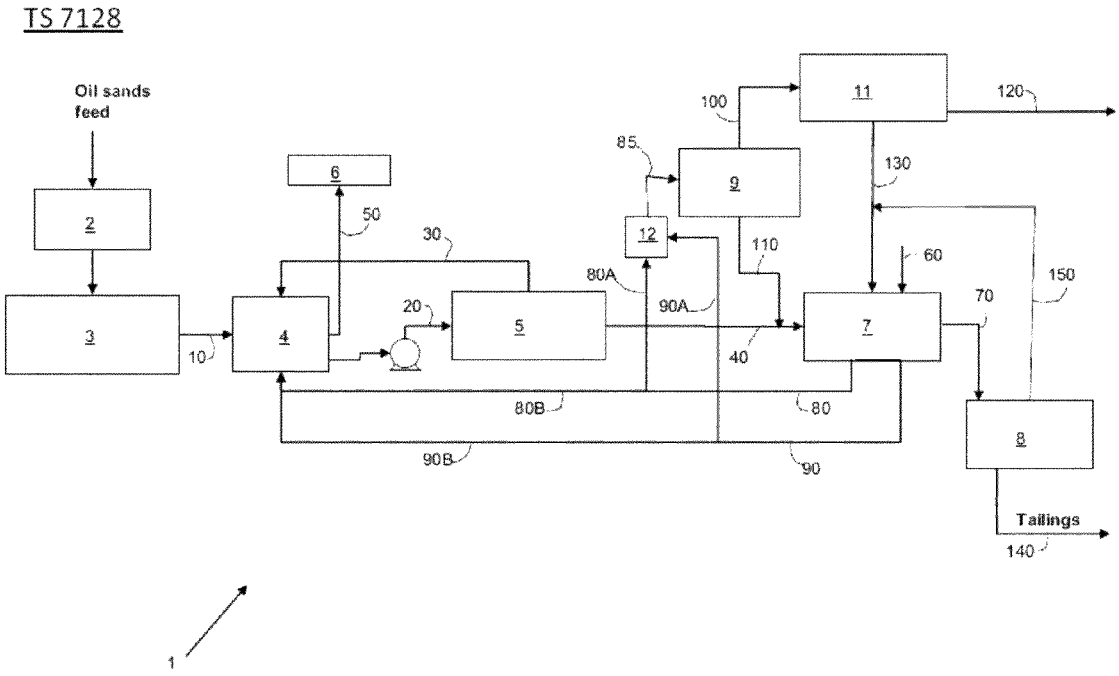
FIG. 1 schematically a process scheme of a first embodiment of the method in accordance with the present invention.

FIG. 1 schematically shows a simplified process scheme of a first embodiment according to the present invention for extracting bitumen (i.e. in the context of the invention a bituminous and/or extremely heavy crude oil like material) from an oil sand stream. The process scheme is generally referred to with reference number 1. The process scheme 1 shows a crusher 2, a de-oxygenation unit 3, a mixer 4, a solid/liquid separator (such as a settler or hydrocylone) 5, a rejects dryer 6, a filter 7, a dryer 8, a clarifier 9, a SRC (solvent recovery column) 11, and a mixer 12.

During use of the process scheme of FIG. 1, an oil sand stream 10 is provided and fed to the mixer 4. Typically, before entering the mixer 4, the oil sand stream 10 has been crushed (e.g. in crusher 2) or treated otherwise, to reduce the size of the larger oil sand lumps to below a pre-determined upper limit. Experience in large scale operations shows that the achievable size upper limit for such size reduction is currently about 8 inch. Further, the oil sand stream is usually de-oxygenated (e.g. in de-oxygenation unit 3), in particular when a non-aqueous solvent is subsequently used for the bitumen extraction.

In the embodiment of FIG. 1, the oil sand stream 10 is contacted in the mixer 4 with a solvent stream preferably containing an aliphatic hydrocarbon solvent (and typically a certain amount of bitumen), thereby obtaining a solvent-diluted oil sand slurry 20. The person skilled in the art will readily understand that to this end a wide variety of streams, both in terms of composition and origin, can be used. In the shown embodiment streams 30, 80B and 90B (which are further discussed below; recycled from downstream of the process) are used, although the person skilled in the art will readily understand that one or more of the streams 30, 80B, 90B may not be used.

Usually, in the mixer 4 (or in a separate unit, if needed, such as a screen), the lumps of the solvent-diluted oil sand slurry obtained are reduced in size, typically to have a diameter below 5.0 cm, preferably below 2.0 cm, more preferably below 1.0 cm. Any undesired materials (such as rocks and woody material) that may hinder downstream processing may be removed by using screens or the like (preferably in the presence of solvent) and the remaining oil sand particles are reduced in size in the presence of the solvent, e.g. by crushing, breaking and/or grinding. Typically the contacting step in mixer 4 is performed at about ambient temperatures, preferably at a temperature in the range from 0-40° C., and at about atmospheric pressure.

In the embodiment of FIG. 1 an optional stream 50 exiting the mixer 4 is shown that may be sent to the rejects dryer 6. This stream 50 may contain rejects (any undesired materials such as rocks and woody material).

The slurry stream 20 exiting the mixer 4 is fed (using a pump) into the settler 5 and allowed to settle, thereby obtaining (as an overflow) a first solids-depleted stream 30 and (as an underflow) a first solids-enriched stream 40. Although additional solvent may be fed to the settler 5, it is preferred that no additional solvent is fed into the settler 5 other than with the slurry stream 20.

In the embodiment of FIG. 1 the first solids-depleted stream 30 is fully recycled to and reused in the mixer 4. A part of the first solids-depleted stream 30 may be sent to and further processed in clarifier 9 to remove fines; if desired, this stream 30 may be combined with stream 80A (and other streams) in mixer 12.

The first solids-enriched stream 40 exiting the settler 5 is fed into the filter 7. Preferably, no intermediate washing with solvent takes place between the settler 5 and the filter 7. In the filter 7, the first solids-enriched stream 40 is filtered, thereby obtaining a bitumen-depleted sand stream 70, a first filtrate 80 and a second filtrate 90. Typically this bitumen-depleted sand stream 70 is the "filter cake" as used in the filter 7. This bitumen-depleted sand stream 70 may be sent to a dryer 8 and removed as dried stream 140; this dried stream 140 would in the art be referred to as "tailings". The dried stream 140 can be used for land reclamation. Of course, if needed, further removal of solvent from the dried stream 140 may be performed. As shown if FIG. 1, a recovered solvent stream 150 may be recycled from the dryer 8 to e.g. the filter 7.

In the embodiment of FIG. 1, a first (usually bitumen-containing) filtrate (removed as stream 80) and a second filtrate (removed as stream 90; usually containing less bitumen than stream 80 and consequently having a higher S/B weight ratio) are obtained in the filter 7. It goes without saying that further filtrate streams may be generated in the filter 7. In the embodiment of FIG. 1, the first filtrate 80 and the second filtrate 90 are both at least partly recycled to the mixer 4 (as streams 80B and 90B), but this recycling of the filtrate streams to the mixer 4 is (although preferred) not essential to the invention in the broadest sense.

As shown in the embodiment of FIG. 1, a stream 60 of fresh solvent may be fed to the filter 7, instead of or in addition of recycled solvent streams 130 (from the SRC 11) and 150 (from the dryer 8); of course other sources of solvent recycle streams may be used as well.

At least a part 80B of the first filtrate stream 80 obtained in the filter 7 is reused in the contacting step in the mixer 4. As shown in the embodiment of FIG. 1, also the second filtrate 90 is partly reused (as stream 90B) in the mixer 4.

A part 80A of the first filtrate 80 and a part 90A of the second filtrate 90 are mixed in mixer 12 and sent to the clarifier 9 as combined stream 85. Instead of or in addition to stream 90A, a different stream or streams may be used to combine with first filtrate stream 80A to obtain the combined stream 85 (which has an increased S/B weight ratio when compared to first filtrate stream 80).

In the clarifier 9 the combined stream 85 is separated, thereby obtaining a second solids-depleted (but bitumen-enriched) overflow stream 100 and a solids-enriched underflow stream 110. As shown in FIG. 1, the second solids-depleted overflow stream 100 of the clarifier 9 may be sent to the SRC 11, whilst the solids-enriched underflow stream 110 of the clarifier 9 may be combined with the solids-enriched stream 40. In the SRC 11, solvent is removed from the overflow 100 of the clarifier 9 thereby obtaining a bitumen-enriched stream 120; the solvent recovered in the SRC 11 may be recycled in the process, e.g. as a solvent stream 130 to the filter 7. A part of the second solids-depleted overflow stream 100 may also be sent to the mixer 4.

It is of note that the slurry stream 20 and the first solids-enriched stream 40 preferably have a relatively low S/B weight ratio (from 0.5 to 1.5) when compared to the S/B weight ratio (preferably above 3.0) of the second filtrate 90.

The person skilled in the art will readily understand that many modifications may be made without departing from the scope of the invention.

The present invention is described below with reference to the following Examples, which are not intended to limit the scope of the present invention in any way.

EXAMPLES

Example 1

In a series of three consecutive runs, a solvent-diluted oil sand slurry was provided (which was used in Example 1 and Comparative Example 1 hereafter). In each run a sample of approximately 1500 g of an Athabasca oil sand (having a bitumen content of 12.3 wt. %; the particles having a diameter below 5.0 cm), 175.3 g solvent (n-pentane) and 411.9 gram diluted bitumen having an S/B weight ratio of 1 were mixed together for 5 minutes under ambient conditions at 1200 rpm using a propeller mixer to form a solvent-diluted oil sand slurry having an S/B weight ratio of about 1.0 and 35 vol. % solids.

The diluted bitumen as used in this Example 1 (and referred to in other examples) was bitumen (containing 20.5 wt. % asphaltenes) diluted with n-pentane. The purpose of adding diluted bitumen was to adjust the vol. % solids of the oil sand slurry to about 35 vol. % to mimic the actual bitumen extraction process.

The solvent-diluted oil sand slurry was then transferred to a settle tube and allowed to settle with a settle rate of 1 cm/min (settle rate is the decantation height divided by time taken for decantation), after which the supernatant liquid ("first solids-depleted stream") was removed from the settled coarse sand fraction ("the first solids-enriched stream"). This settled sand fraction was then remixed again using a tumbler mixer (Reax 20, at 15 rpm settings, 5 min.) and transferred to a filtration vessel (filter diameter of 78 mm), allowed to settle, and the surface of the filter cake was leveled (height of the filter cake was about 18 cm). Remaining supernatant liquid on top of the filter cake was pushed through the filter cake until only a thin (1 mm) layer of supernatant liquid remained (pressure difference over the filter cake was 0.4 bar).

225 g of fresh solvent (n-pentane) was added as a wash solvent on top of the filter cake and pushed through the filter cake until only a thin (1 mm) layer of supernatant liquid remained.

The filtrate together with the remaining supernatant liquid collected was the first filtrate "A". The three filtrates "A" from the three consecutive runs were blended together to produce one combined filtrate sample and successively divided again into two (dilbit) samples "S1" with similar solid content. By evaporation at ambient temperature and pressure, the S/B weight ratio of the sample "S1" was decreased to 0.6 to obtain a desired lower S/B weight ratio. The sample "S1" was used as a starting material for this Example 1 and the Comparative Example 1 hereinafter.

In this Example 1, 252.5 g of sample "S1" was poured into a glass settle tube (internal diameter=4 cm), resulting in dilbit height of 30.5 cm. 147.1 g of n-pentane was poured into the same tube, resulting in total dilbit height of 56 cm and an (increased) average S/B weight ratio of 1.6. The total dilbit content in the settle tube was mixed by turning the settle tube 10 times up and down and up again. After this, the dilbit fraction was allowed to settle for 15 minutes. Samples were divided into three fractions: top fraction "Ftop1" (between 17-45.5 cm), middle fraction "Ftop2" (between 45.5-56 cm) and the bottom fraction "Fbot" (between 0-17 cm).

The three different fractions were analyzed on ash content and pentane-insoluble asphaltene content using the procedure of ASTM D482. The ash content reported in Table 1 is with respect to the bitumen content in the sample.

Comparative Example 1

250.8 g of dilbit sample "S1" (as obtained in Example 1) was poured into a glass settle tube (internal diameter=4 cm), resulting in dilbit height "H1" of 30 cm. The dilbit in the settle tube was mixed by turning the settle tube 10 times up and down and up again. After this, the dilbit fraction was allowed to settle for 15 minutes. Samples were divided into three fractions: top fraction "Ftop1" (between 17-25 cm), middle fraction "Ftop2" (between 25-30 cm), and the bottom fraction "Fbot" (between 0-17 cm). The samples were again analyzed using the procedure of ASTM D482; the values are given in Table 1 below.

TABLE 1

| | S/B weight ratio of S1 | Settle time [min] | Dilbit height H1 [cm] | Fraction | S/B weight ratio | Ash content [wt. %] | Asphaltene [wt. %] |
|---|---|---|---|---|---|---|---|
| Example 1 | 1.6 | 15 | 56 | Ftop1 | 1.79 | 0.04 | 8.6 |
| | | | | Ftop2 | 1.77 | 0.04 | 8.6 |
| | | | | Fbot | 1.30 | 2.60 | 27.9[1] |
| Comp. Ex. 1 | 0.6 | 15 | 30 | Ftop1 | 0.62 | 1.08 | 18.6 |
| | | | | Ftop2 | 0.58 | 1.05 | 17.5 |
| | | | | Fbot | 0.60 | 1.10 | 18.6 |

[1]Part of the asphaltene was precipitated.

Example 2

Although not all the steps of the method of the present invention were performed in this Example 2, this Example 2 serves to show the effect of using the first filtrate (stream 80 in FIG. 1) as feed to the clarifier (9 in FIG. 1; Example 2), instead of stream 30 (coming from the solid/liquid separator 5 in FIG. 1; Comparative Example 2).

A 754.5 g sample of an Athabasca oil sand (having a bitumen content of 9.9 wt. %; the particles having a diameter below 5.0 cm), 63.7 g solvent (n-pentane) and 279.5 gram diluted bitumen (having an S/B weight ratio of 1.0) were mixed for 10 minutes under ambient conditions at 900 rpm using a propeller type mixer to form a solvent-diluted oil sand slurry with an S/B weight ratio of about 1.0 and a solids content of about 35 vol. %. The solvent-diluted oil sand slurry was then transferred to a settle tube (5 cm diameter) and allowed to settle for 10 min, after which the supernatant liquid "D" ("first solids-depleted stream") was removed from the settled coarse sand fraction ("the first solids-enriched stream"). This course settled sand fraction was then remixed again using a tumbler for 5 min (Reax 20, at 15 rpm settings) and transferred to a filtration vessel (78 mm diameter), allowed to settle, and the surface of the filter cake leveled with a filter cake height of about 9 cm. Remaining supernatant liquid on top of the filter cake was pushed through the filter cake until only a thin (1 mm) layer of supernatant liquid remained (pressure difference over the filter cake was 1.8 bar). 114.8 g of fresh solvent (n-pentane) was added as a wash solvent on top of the filter cake and pushed through the filter cake until only a thin (1 mm) layer of supernatant liquid remained. The filtrate and remaining supernatant liquid collected was the first filtrate "A" with an average S/B weight ratio of 1.07.

Pentane was removed from filtrate "A" to measure the ash content in the filtrate A sample (as determined according to ASTM D482). The ash content in the bitumen (in filtrate A) is reported in Table 2.

Comparative Example 2

A 750.1 g sample of an Athabasca oil sand (having a bitumen content of 9.9 wt. % and particles having a diameter below 5.0 cm), 63.8 g solvent (n-pentane) and 278.1 gram diluted bitumen (a pentane/bitumen mixture at S/B weight ratio of 1.0) were mixed for 10 minutes under ambient conditions at 900 rpm using a propeller type mixer to form a solvent-diluted oil sand slurry with an S/B weight ratio of about 1.0 and a solids content of about 35 vol. %. The solvent-diluted oil sand slurry was then transferred to a settle tube (settler tube diameter of 5 cm) and allowed to settle with a settle rate of 1.7 cm/min, after which the supernatant liquid "D2" was removed at 2 cm above the settled coarse sand fraction interface. Pentane was removed from supernatant liquid "D2" to measure the ash content in it (as determined according to ASTM D482). The ash content in the bitumen (in supernatant liquid "D2") is reported in Table 2.

TABLE 2

| | Example 2 | Comp. Ex. 2 |
|---|---|---|
| Ash content in bitumen in filtrate "A" [wt. %] | 1.10 | — |
| Ash content in bitumen in decantate "D2" [wt. %] | — | 7.41 |

Example 3

In order to show the effect of the S/B weight ratio of the solvent-diluted oil sand slurry on the bitumen recovery, two experiments were performed with a different S/B weight ratio (1.0 for Example 3 and 2.3 for Example 4).

A 40 kg sample of an Athabasca oil sand having a bitumen content of 12.58 wt. % (selected to contain lumps having a diameter of less than 10 cm) was mixed with 5.05 kg of solvent (n-pentane) and 10.75 kg of diluted bitumen with an S/B weight ratio of 1.0 to obtain a solvent-diluted oil sand slurry having an S/B weight ratio of 1.0 an having a 35 vol. % solids content.

The solvent-diluted oil sand slurry was mixed in a Patterson brand 0.05 cubic meter double cone blender at 45 rpm for 10 minutes. The solvent-diluted oil sand slurry was then allowed to settle for 10 minutes and the free liquid ("the first solids-depleted stream") on top of the solids was removed (to obtain "the first solids-enriched stream"). The first solids-enriched stream was then remixed for 1 minute, loaded into a filter and then leveled. The filter was 50 cm in diameter and the height of the filter cake was approximately 15 cm. Any additional free liquid that settled to the top of the filter bed was pushed to just below the filter cake surface using a nitrogen overpressure ("delta p") of 0.3 barg. 6 kg of fresh solvent (n-pentane; "wash solvent 1") was added as a wash to the top of the filter and pushed through until the liquid surface just dropped below the solid surface. The filtrate was collected. The time taken for filtration (wash time 1) is given in Table 3. An additional amount of 6 kg wash solvent ("wash solvent 2") was placed on top of the filter cake and pushed through the bed until no further liquid evolved from the bottom of the bed. The time taken for filtration (wash time 2) is given in Table 3. Remaining solvent was removed from the sand by purging with nitrogen. Bitumen recovery was based on Dean-Stark analysis of the filter cake (hence: bitumen recovery=(bitumen intake−bitumen in filter cake)/(bitumen intake)).

Example 4

A 40 kg sample of an Athabasca oil sand having a bitumen content of 12.58 wt. %; selected to contain lumps having a diameter of less than 10 cm was mixed with 11.57 kg of solvent (n-pentane) and 2.87 kg of dilbit with an S/B weight ratio of 2.3 to reach an S/B weight ratio of 2.3 with a 35 vol. % solids content. The same experimental procedure as mentioned for Example 3 was repeated and results are given in Table 3.

TABLE 3

| | Example 3 | Example 4 |
|---|---|---|
| Oil sand [kg] | 40 | 40 |
| Solvent [kg] | 5.05 | 11.57 |
| S/B weight ratio of solvent-diluted oil sand slurry | 1 | 2.3 |
| Wash solvent 1 [kg] | 6 | 6 |
| Wash time 1 [s] | 22 | 22 |
| Wash solvent 2 [kg] | 6 | 6 |
| Wash time 2 [s] | 26 | 24 |
| Delta p [barg] | 0.3 | 0.3 |
| Bitumen recovery [%] | 96 | 77 |

DISCUSSION

Example 1 shows that when the separation of the filtrate (in step (f)) is performed on a filtrate stream having an increased S/B weight ratio (0.6 for Comparative Example 1 and 1.6 for Example 1), a (desired) lower ash content is obtained in the second solids depleted stream (overflow stream 100 in FIG. 1). In this respect it is noted that when the separation of step (f) is performed at an S/B weight ratio of 0.6 (as in Comp. Ex. 1), a similar ash content value (ranging from 1.05 to 1.10 wt. %) is observed in all three fractions, indicating that no settling of fines occurs. Hence, when the S/B weight ratio of the filtrate is increased (as is the case in Example 1) from 0.6 to 1.6 by solvent addition, asphaltene precipitation occurs, which is confirmed by the higher asphaltene content of 27.9% in the bottom fraction (Fbot) for Example 1. The precipitated asphaltene helps in agglomeration of fines and this result in the lower ash content value of 0.04 wt % in the bitumen in top fraction, compared to 1.08 wt % in the absence of any asphaltene precipitation at an S/B weight ratio of 0.6 as in Comp. Ex. 1.

Example 2 shows the benefit according to the present invention of using the first filtrate (stream 80 in FIG. 1) as feed to the clarifier 9, instead of stream 30 (coming from the solid/liquid separator 5 in FIG. 1; Comparative Example 2). As the first filtrate 80 has a significantly lower ash content than stream 30 (see Table 2), there is a preference for using the first filtrate 80 (as done according to the present invention), as less fines have to be removed in step (f).

Figure 2:
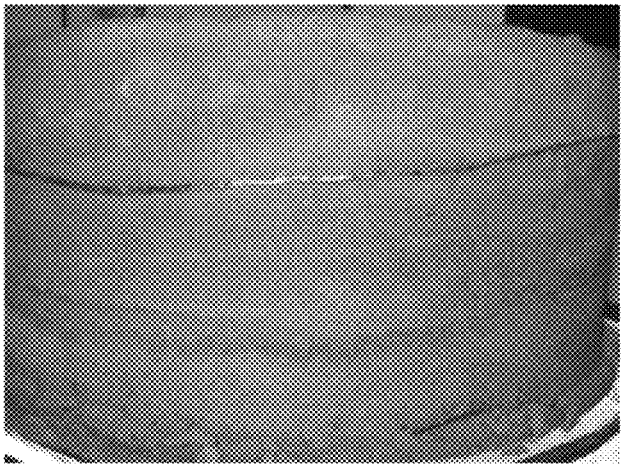
FIG. 2 is a copy of a picture of a filter cake obtained from an experiment similar to example 4.

As can be learned from Example 3, the method according to the present invention provides a process suitable for recovering the majority (more than 90%) of the bitumen present in the oil sand. Example 3 and Example 4 show the effect of S/B weight ratio of the solvent-diluted oil sand slurry on filter performance. As can be learned from Table 3, a higher overall bitumen recovery (96%) is obtained at S/B weight ratio of 1 (Example 3) while a lower bitumen recovery is obtained (77%) at an S/B weight ratio of 2.3 (Example 4). Only part of this lower recovery can be explained by the fact that at S/B weight ratio of 2.3 about 9% of the bitumen is rejected from the solution as precipitated asphaltenes. The other reason is that the undissolved asphaltenes partly block the filter cake and channeling of the wash solvent is observed in the experiments at higher S/B weight ratio. The partial blocking of the filter cake unit is clearly evident from FIG. 2 (which is a picture of the filter cake as obtained in an experiment similar to Example 4) which shows the presence of a layer of undissolved asphaltenes in the filter cake at high S/B weight ratio (2.3).

We claim:

1. A method for extracting bitumen from an oil sand stream, the method comprising the steps of:

(a) providing an oil sand stream;

(b) contacting the oil sand stream with a liquid, the liquid comprising a solvent comprising an aliphatic hydrocarbon having from 3 to 9 carbon atoms per molecule thereby obtaining a solvent-diluted oil sand slurry wherein at least about 90 percent by weight of asphaltenes in the oil sand stream remain dissolved;

(c) separating the solvent-diluted oil sand slurry, thereby obtaining a first solids-depleted stream and a first solids-enriched stream;

(d) filtering the first solids-enriched stream obtained in step (c), thereby obtaining bitumen-depleted sand and at least a first filtrate, and a second filtrate, and the second filtrate is at least partly reused in the contacting of step (b);

(e) increasing a S/B weight ratio of at least a part of the first filtrate by combining it with a stream having a higher S/B weight ratio thereby obtaining a combined stream wherein at least some asphaltenes are caused to precipitate from the combined stream; and (f) separating the combined stream, thereby obtaining a second solids-depleted stream and a second solids-enriched stream wherein the second solids-depleted stream comprises less than two percent by weight of solids.

2. The method of claim 1, wherein the solvent in step (b) comprises less than one percent by weight aromatics.

3. The method of claim 2, wherein the aliphatic hydrocarbon has from 4 to 7 carbons per molecule.

4. The method of claim 1 wherein the solvent-diluted oil sand slurry obtained in step (b) has a solvent-to-bitumen (S/B) weight ratio of from 0.5 to 1.5.

5. The method of claim 4 wherein the solvent-diluted oil sand slurry obtained in step (b) has a solvent-to-bitumen (S/B) weight ratio of from 0.6 to 1.3.

6. The method of claim 5 wherein the solvent-diluted oil sand slurry obtained in step (b) has a solvent-to-bitumen (S/B) weight ratio of from 0.7 to 1.1.

7. The method of claim 1 wherein the solvent-diluted oil sand slurry obtained in step (b) comprises from 10 to 60 volume percent of solids.

8. The method of claim 7 wherein the solvent-diluted oil sand slurry obtained in step (b) comprises from 20 to 40 volume percent of solids.

9. The method of claim 1 wherein the first solids-enriched stream obtained in step (c) comprises from 30 to 70 volume percent of solids.

10. The method of claim 9 wherein the first solids-enriched stream obtained in step (c) comprises above 40 volume percent of solids.

11. The method of claim 1 wherein at least a part of the first solids-depleted stream is reused in the contacting of step (b).

12. The method of claim 1 wherein the first filtrate has a S/B weight ratio of from 0.5 to 1.5.

13. The method of claim 12 wherein the first filtrate has a S/B weight ratio of from 0.7 to 1.1.

14. The method of claim 1 wherein the first filtrate comprises at most 5.0 wt. % of solids, based on the bitumen content in the first filtrate.

15. The method of claim 1 wherein a part of the first filtrate is reused in the contacting of step (b).

16. The method of claim 1, wherein the second filtrate has a S/B weight ratio of above 3.0.

17. The method of claim 1 wherein in step (e) at least a part of the first filtrate is combined with at least a part of the second filtrate.

18. The method of claim 1 wherein the combined stream in step (e) has an S/B weight ratio of at least 1.1.

19. The method of claim 1 wherein the second solids-enriched stream obtained in step (f) is reused in the filtering of step (d).

20. The method of claim 1 wherein the oil sand is an Athabasca oil sand.

21. The method of claim 1 wherein the solids-depleted stream comprises about 0.04 percent by weight ash.

* * * * *